US009446577B2

(12) United States Patent
Ezure

(10) Patent No.: US 9,446,577 B2
(45) Date of Patent: Sep. 20, 2016

(54) PRINTING SCREEN MAKING APPARATUS

(71) Applicant: RISO KAGAKU CORPORATION, Minato-ku, Tokyo (JP)

(72) Inventor: Shinichi Ezure, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/918,883

(22) Filed: Oct. 21, 2015

(65) Prior Publication Data

US 2016/0114570 A1 Apr. 28, 2016

(30) Foreign Application Priority Data

Oct. 23, 2014 (JP) ..... 2014-216469

(51) Int. Cl.
*B41C 1/055* (2006.01)
*B41L 13/02* (2006.01)
*B41C 1/14* (2006.01)

(52) U.S. Cl.
CPC *B41C 1/144* (2013.01); *B41C 1/14* (2013.01)

(58) Field of Classification Search
CPC ..... B41C 1/14; B41C 1/144; B41C 1/145; B41C 1/055; B41L 13/02
USPC ..... 101/128.4, 128.21
See application file for complete search history.

(56) References Cited

U.S. PATENT DOCUMENTS 5,687,646 A * 11/1997 Sakaguchi ..... B41C 1/144 101/128.4
5,701,816 A * 12/1997 Fujiwara ..... B41C 1/144 101/127.1

FOREIGN PATENT DOCUMENTS

JP H06-270379 A 9/1994
JP 09070942 A * 3/1997
JP H09-070940 A 3/1997
JP 2002029021 A * 1/2002

* cited by examiner

*Primary Examiner* — Leslie J Evanisko
(74) *Attorney, Agent, or Firm* — Manabu Kanesaka

(57) ABSTRACT

A tension obtaining unit obtains a measured tension value by measuring tension in sub-areas where tension should be obtained, which are set in a screen area to perforate of a stretched screen master. A control unit calculates tension in sub-areas where tension should not be obtained of the screen area to perforate as computed tension values by modifying the measured tension value, based on predefined information for tension computation. The control unit compares the measured tension value and computed tension values against information for determining perforation conditions stored in a storage unit and controls a screen making unit to execute perforation on determined perforation conditions fit for tension in the sub-areas where tension should be obtained and for tension in the sub-areas where tension should not be obtained.

4 Claims, 9 Drawing Sheets

FIG. 3A
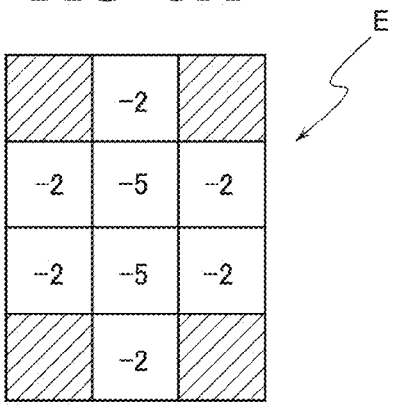
MODIFYING VALUES FOR
FRAME SIZE OF 600 mm x 800 mm
FIG. 3B
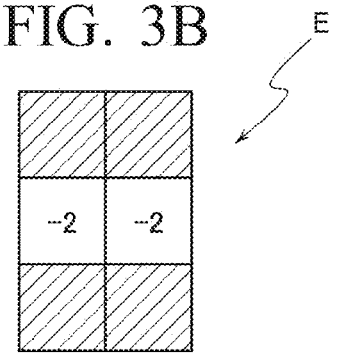
MODIFYING VALUES FOR
FRAME SIZE OF 400 mm x 600 mm
FIG. 3C
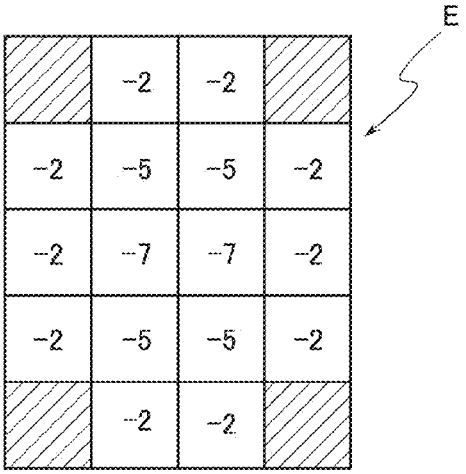
MODIFYING VALUES FOR
FRAME SIZE OF 800 mm x 1000 mm
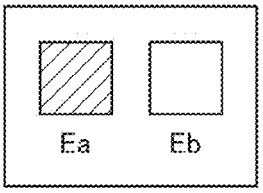

FIG. 5A

| | | |
|---|---|---|
| 16 | 14 | 16 |
| 14 | 11 | 14 |
| 14 | 11 | 14 |
| 16 | 14 | 16 |

CALCULATING PROVISIONAL TENSION VALUES BY MODIFYING MEASURED TENSION VALUE (AVERAGE OF 16 N/m) WITH MODIFYING VALUES FOR FRAME SIZE OF 600 mm x 800 mm

FIG. 5B

| | | |
|---|---|---|
| 16 | 14 | 16 |
| 14 | 11 | 14 |
| 14 | 11 | 14 |
| 16 | 14 | 16 |

MULTIPLYING PROVISIONAL TENSION VALUES BY MATERIAL DEPENDENT COEFFICIENT OF "1"

FIG. 5C

| | | |
|---|---|---|
| 16 | 14 | 16 |
| 14 | 11 | 14 |
| 14 | 11 | 14 |
| 16 | 14 | 16 |

MULTIPLYING PROVISIONAL TENSION VALUES BY MESH COUNT DEPENDENT COEFFICIENT OF "1"

FIG. 5D

| | | |
|---|---|---|
| 16 | 14 | 16 |
| 14 | 11 | 14 |
| 14 | 11 | 14 |
| 16 | 14 | 16 |

OBTAINING COMPUTED TENSION VALUES FOR EACH OF SUB-AREAS Eb WHERE TENSION SHOULD NOT BE OBTAINED

PRINTING SCREEN MAKING APPARATUS

RELATED APPLICATIONS

The present application is based on, and claims priority from, Japanese Application No. JP2014-216469 filed Oct. 23, 2014, the disclosure of which is hereby incorporated by reference herein in its entirety.

TECHNICAL FIELD

The present invention relates to a printing screen making apparatus that perforates a stretched screen master with a desired image, in which the screen master is made of a thermally fusible film bonded to a mesh fabric and stretched in a tense state on a frame.

BACKGROUND OF ART

Heretofore, as a kind of stencil printing, screen printing that forces a printing substance through open mesh apertures perforated with a desired image pattern onto an object to be printed, thus transferring the printing substance to the object, is known. For this screen printing, making a printing screen is performed as follows. A "stretched screen master" is prepared by stretching a screen master on a frame in a tense state with predetermined tensile force. The screen master is made by bonding a thermally fusible film (hereinafter, simply referred to as a "film") which is made of a thermoplastic resin such as polyester film or polyvinyl chloride film to a mesh fabric which is a mesh of plain fabrics made of weft and warp fibers of, e.g., silk, synthetic resin (such as nylon and tetrone), stainless, etc. with an adhesive agent. A film surface of the stretched screen master thus prepared is thermally perforated by a thermal head which is a perforation unit and a desired perforated image is created. As an apparatus for making such a printing screen, apparatuses which are disclosed in, e.g., Japanese Unexamined Patent Application Publications No. Hei 6-270379 and No. Hei 9-70940 are publicly known.

In an apparatus of Japanese Unexamined Patent Application Publication No. Hei 6-270379, the master part of a stretched screen master is mounted on a flat plate platen which is fit for the size of the stretched screen master and making a printing screen is performed in a state in which the screen has been brought in close contact with the thermal head. In an apparatus of Japanese Unexamined Patent Application Publication No. Hei 9-70940, a screen master is held between a long thermal head which contacts the entire width of the mesh fabric of the screen master and a platen which is provided to face the thermal head and making a printing screen is performed in a state in which the master has been brought in close contact with the thermal head.

SUMMARY OF INVENTION

Technical Problem

However, in the printing screen making apparatuses disclosed in each of the abovementioned publications, the contact between a screen master and the thermal head is assured by using a platen whose dimensions match the size of the stretched screen master. Thus, a plurality of platens must be prepared for different sizes of stretched screen masters from which a printing screen is made and the management of the platens has been troublesome.

Accordingly, an apparatus for making a printing screen without using a platen has been developed to dispense with the platen management task and improve general versatility. This apparatus performs a screen making process in a state in which a movable thermal head disposed to face the film surface of a stretched screen master has been brought in close contact with the stretched screen master by its own weight.

Nevertheless, in the new apparatus for making a printing screen, the film of the screen is perforated properly in a screen portion where the contact between the thermal head and a screen master is assured, as is presented in FIG. 8A. But, poor perforation occurs in a portion of the screen area to perforate where the contact between the thermal head and a screen master is lowered, as is presented in FIG. 8B. In consequence, problems occur, such as half-tone image quality degradation and blurred edges of a screen-printed image.

The present inventors have earnestly made a study to solve this problem and found that the contact between the thermal head and a screen master decreases with an increase in the size of a stretched screen master and presumed that this is attributed to variation in tension across the screen area to perforate of the stretched screen master.

To verify the above presumption, the present inventors have prepared screen masters stretched on frames of different sizes in a tense state with given tensile force applied to the screen masters. FIGS. 9A to 9C are diagrams representing results of qualitative analysis of distributions of tension across these screen masters depending on the frame sizes.

For a stretched screen master presented in FIG. 9A, its frame size is smaller than the frames for other screen masters and relatively high tension is maintained across the screen master. For stretched screen masters presented in FIGS. 9B and 9C, however, it is observed that, as the frame size increases, the tension of the screen master weakens overall, and the tension in a central portion tends to become significantly weaker than the tension in portions near the frame. For some frame sizes, it has also been observed that the screen master tension differs by its portions, even if the screen is stretched with uniform tensile force. If different types of screen masters (which differ in terms of the mesh fabric material and the mesh count) are used, the screen masters naturally have different strengths and, thus, it is also presumed that further variation occurs in the tension of the screen masters.

From the foregoing matters, the present inventors ascertained that the cause of the problems occurring with the new apparatus for making a printing screen lies in a decrease in the contact between the perforation unit and the screen master due to variation in tension occurred across the screen area to perforate depending on the specifications (screen master type and frame size) of stretched screen masters. To solve this problem, the inventors have learned that screen making needs to be performed on suitable perforation conditions (perforation energy and perforation pressure) for a stretched screen master used.

Therefore, an object of the present invention developed in view of the foregoing problem is to provide a printing screen making apparatus capable of performing a process of making a good printing screen free from poor perforation, independently of the type of a screen master used and the frame size.

Solution to Problem

To achieve the above object, a first aspect of the invention resides in a printing screen making apparatus including:

a perforation unit that moves relatively to a stretched screen master prepared by stretching a screen master made of a mesh fabric and a thermally fusible film on a frame in a tense state with predetermined tensile force and thermally fuses and perforates segments of the film corresponding to image components in original data;

a tension obtaining unit that obtains tension in a predetermined screen area to perforate of the stretched screen master; and a control unit that controls the perforation unit to execute perforation on perforation conditions set according to tension obtained by the tension obtaining unit.

According to a second aspect of the invention, in the printing screen making apparatus pertaining to the first aspect, the tension obtaining unit obtains tension from sub-areas where tension should be obtained, which are set in the screen area to perforate of the stretched screen master, and the control unit computes tension in sub-areas where tension should not be obtained of the screen area to perforate, other than the sub-areas where tension should be obtained, from the tension obtained by the tension obtaining unit, determines perforation conditions in the sub-areas where tension should not be obtained from the thus computed tension, and determines perforation conditions in the sub-areas where tension should be obtained from the tension obtained by the tension obtaining unit.

According to a third aspect of the invention, in the printing screen making apparatus pertaining to the second aspect, the control unit includes:

a tension computing unit that calculates provisional tension values by modifying a measured tension value, the tension measured by the tension obtaining unit from the sub-areas where tension should be obtained, with modifying values which differ by frame size, set for each size of the stretched frame master, and calculates computed tension values as tension in the sub-areas where tension should not be obtained by multiplying the provisional calculated tension values by a material dependent coefficient for material of the mesh fabric in the screen master and a mesh count dependent coefficient for a mesh count of the mesh fabric; and a perforation conditions determination processing unit that compares the measured tension value and the computed tension values against information for determining perforation conditions, which represents a relation between tension and perforation conditions, determines perforation conditions fit for the measured tension value and the computed tension values, and controls the perforation unit to execute perforation on the determined perforation conditions.

According to a fourth aspect of the invention, in the printing screen making apparatus pertaining to any of the first through third aspects, the tension obtaining unit, when obtaining tension, calculates tension of the screen master from pressing force exerted when the perforation unit has been pressed against the screen master film surface in the screen area to perforate of the stretched screen master, and the control unit, when making a printing screen, controls the perforation unit to execute perforation on perforation conditions fit for tension of the screen master obtained by the tension obtaining unit.

Advantageous Effects of Invention

According to the printing screen making apparatus pertaining to the first aspect, even if variation in tension across the screen area to perforate occurred depending on the size of a frame and the type of a screen master of a stretched screen master, the apparatus can perform a process of making a printing screen on peroration conditions suitable for screen master portions in which variation in tension occurred. Thus, a stable process of making a printing screen can be performed only with the perforation unit (thermal head). Poor perforation attributed to variation in tension can be eliminated, which eventually leads to improvement in image quality of half-tone and edges.

According to the printing screen making apparatus pertaining to the second or third aspect, the apparatus computes tension (computed tension values) in sub-areas where tension should not be obtained of the screen area to perforate, based on tension (a measured tension value) in sub-areas where tension should be obtained, which are set in the screen area to perforate of a stretched screen master, and using predefined information for tension computation. It is thus possible to capture variation in tension occurred across the screen area to perforate with ease without obtaining tension in all sub-areas of the screen area to perforate.

According to the printing screen making apparatus pertaining to the fourth aspect, when obtaining tension, the apparatus makes a screen making unit serve as the tension obtaining unit to calculate tension of the screen master from pressing force exerted when the perforation unit has been pressed against the film surface of the stretched screen master. When making a printing screen, the perforation unit is controlled to execute perforation on perforation conditions fit for the obtained tension. It is thus possible to simplify the apparatus structure.

BRIEF DESCRIPTION OF DRAWINGS

FIG. 3A is a diagram presenting an example of modifying values for a frame size in modifying values which differ by frame size included in information for tension computation;

FIG. 3B is a diagram presenting another example of modifying values for a frame size;

FIG. 3C is a diagram presenting another example of modifying values for a frame size;

FIGS. 5A to 5D are diagrams representing an example of a process of computing tension in sub-areas where tension should not be obtained;

DESCRIPTION OF EMBODIMENTS

In the following, embodiments for carrying out the present invention will be described in detail with reference of the accompanying drawings. These embodiments are not intended to limit the scope of the present invention thereto. Other practicable embodiments, examples, and operating techniques or the like that can occur to those skilled in the art based on these embodiments are considered to be included in the scope of the present invention.

A printing screen making apparatus 1 pertaining to the present invention makes a printing screen by perforating a so-called "stretched screen master 20" which is prepared as follows. A screen master 21 is made up of a thermally fusible film which is made of a thermoplastic resin such as polyester film or polyvinyl chloride film and a mesh fabric in which weft and warp threads of, e.g., silk, synthetic resin (such as nylon and tetrone), stainless, etc. are plain woven such that the these threads cross each other at predetermined intervals to form a mesh grid structure. The screen master 21 is stretched on a frame 22 (typically made of aluminum, stainless steel, wood, etc.) in a tense state with predetermined tensile force.

Figure 1A:
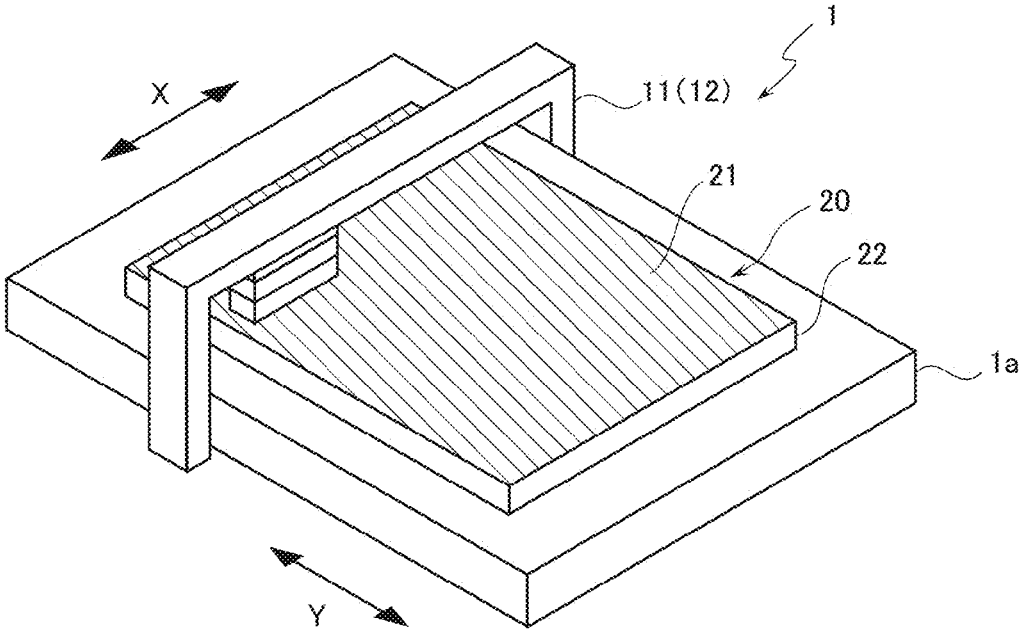
FIG. 1A is a schematic perspective view depicting a structure of a printing screen making apparatus of a first embodiment pertaining to the present invention.
Figure 1B:
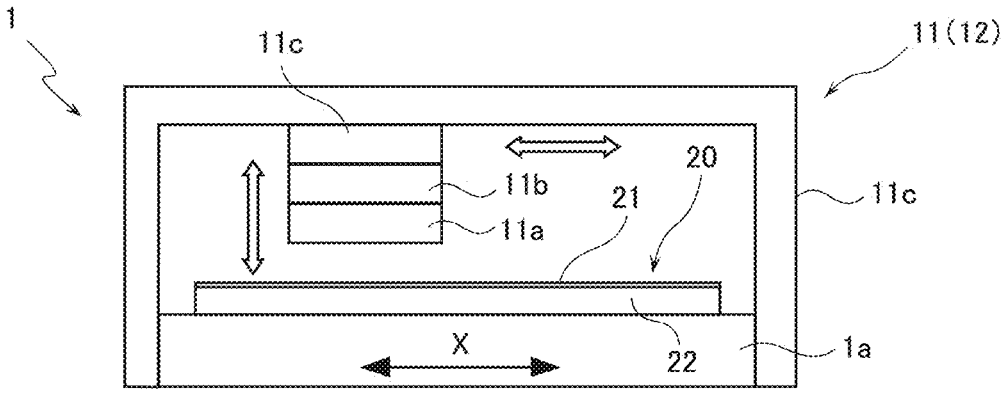
FIG. 1B is a side view of the same apparatus.

In the following description, as is indicated in FIG. 1, a crosswise direction of a stretched screen master 20 depicted in the drawing is defined as a "first-scan direction X" and a vertical direction (i.e., a direction perpendicular to the first-scan direction X) of a stretched screen master 20 depicted in the drawing is defined as a "slow-scan direction Y". In embodiments which will be described below, therefore, a short-side direction of a stretched screen master 20 corresponds to the first-scan direction X and a long-side direction corresponds to the slow-scan direction Y.

[First Embodiment]

A structure of a printing screen making apparatus 1 of a first embodiment pertaining to the present invention is first described.

The printing screen making apparatus 1 of the first embodiment is configured to measure tension in sub-areas Ea where tension should be obtained, which are predetermined in a screen area to perforate (corresponding to the entire film surface of a screen master 21) of a stretched screen master 20, compute tension in other sub-areas (sub-areas where tension should not be obtained) in the screen area E to perforate, determine perforation conditions according to a result of the computation, and perform a process of making a printing screen.

<Apparatus Structure>

Figure 2:
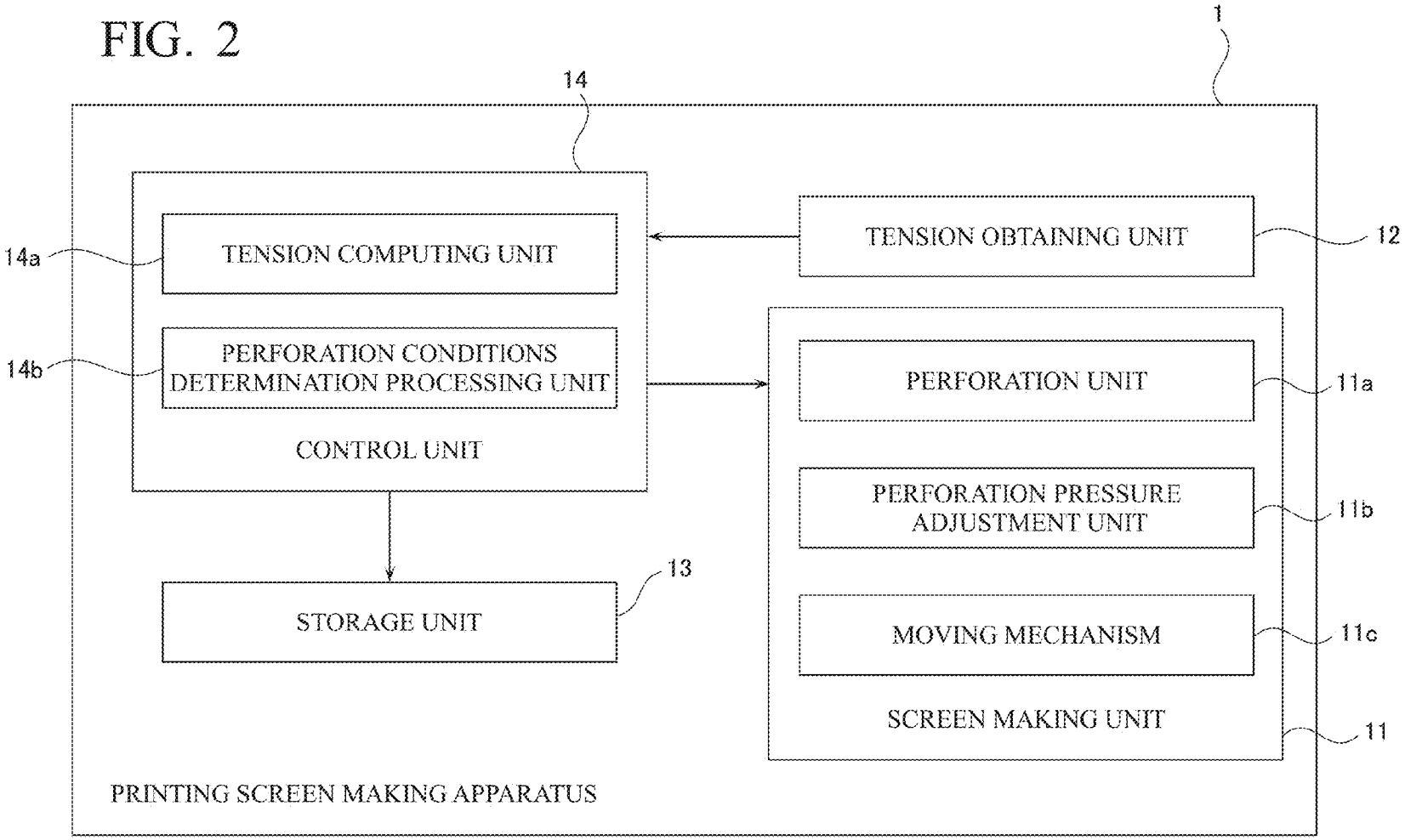
FIG. 2 is a functional block diagram of the printing screen making apparatus of the first embodiment.

As depicted in FIG. 1 or FIG. 2, the printing screen making apparatus 1 of the present example includes a screen pedestal 1*a*, a screen making unit 11 which thermally perforates a stretched screen master 20 mounted on the screen pedestal 1*a*, a tension obtaining unit 12 which obtains tension in predetermined sub-areas in the screen area E to perforate of a stretched screen master 20, a storage unit 13 which stores original data and various data required for a process of making a printing screen, and a control unit 14 which controls the screen making unit 11 according to perforation conditions (perforation energy and perforation pressure) suitable for a stretched screen master 20.

The screen making unit 11 includes a perforation unit 11*a* formed of a thermal head which is disposed in a state in which it faces the film surface of the screen master surface of a stretched screen master 20 mounted on the screen pedestal 1*a* and has numerous heater elements arrayed along the first-scan direction X on its surface (printing surface) facing the screen master 21 and a perforation pressure adjustment unit 11*b* which presses the perforation unit 11*a* onto the screen master surface from above to exert a predetermined perforation pressure on the perforation unit 11*a*. The perforation unit 11*a* and the perforation pressure adjustment unit 11*b* are engaged with each other. The screen making unit 11 also includes a moving mechanism 11*c* which moves the perforation unit 11*a* and the perforation pressure adjustment unit 11*b* appropriately in the first-scan direction X and slow-scan direction Y in the screen area E to perforate.

While the screen making unit 11 moves appropriately in the screen area E to perforate according to original data under control by the control unit 14, it makes the perforation unit 11*a* press-contact the screen master surface at a predetermined perforation pressure given by the perforation pressure adjustment unit 11*b*, while driving the heater elements intermittently. Thereby, film segments corresponding to image components in the original data are thermally perforated on a per-pixel basis.

When in a process of making a printing screen, the screen making unit 11 moves in routes as described below. From a screen making process start position, first, the screen making unit 11 is made to go forward and backward in the slow-scan direction Y to make a printing screen in one lane of screen making. At this time, when going forward, a predetermined perforation pressure is exerted on the screen making unit 11; i.e., the perforation pressure adjustment unit 11*b* presses the perforation unit 11*a* against the surface of the screen master 21 to perforate the stretched screen master 20. When going backward, the perforation pressure is not exerted on the screen making unit 11; i.e., the pressure to press the perforation unit against the surface of the screen master 21 is removed. Then, the screen making unit 11 is made to move by a predetermined distance in the first-scan direction X to move to the next lane of screen making and the screen making unit 11 is made to go forward and backward in the slow-scan direction Y to make a printing screen in the next lane. Subsequently, the screen making unit 11 is made to move in this way appropriately in the first-scan direction X and slow-scan direction Y to make a printing screen across the screen area E to perforate.

The tension obtaining unit 12 obtains tension Ea in predetermined sub-areas where tension should be obtained in the screen area E to perforate in a state in which it is brought in contact with the screen master surface of a stretched screen master 20 and outputs the thus obtained tension as a measured tension value to the control unit 14. In the present embodiment, the screen making unit 11 also serves as the tension obtaining unit 12 and, when obtaining tension, calculates tension in the sub-areas Ea where tension should be obtained from the pressing force exerted when the perforation pressure adjustment unit 11*b* has pressed the perforation unit 11*a* against the screen master surface with predetermined pressing force. The process of making a printing screen is not yet started when the screen making unit 11 serves as the tension obtaining unit 12 and, thus, the perforation unit 11*a* is not yet heated, of course.

Sub-areas Ea where tension should be obtained by the tension obtaining unit 12 are set as follows. The screen area E to perforate is divided into a given number of sub-areas depending on the size of a stretched screen master 20. From among these subareas, several ones are set as those suitable for measuring tension depending on the size of a stretched screen master 20.

FIG. 3A is an example in which a stretched screen master 20 which has a size of 600 mm×800 mm is divided into 12 sub-areas in 4 rows and 3 columns. FIG. 3B is an example in which a stretched screen master 20 which has a size of 400 mm×600 mm is divided into 6 sub-areas in 3 rows and 2 columns. FIG. 3C is an example in which a stretched screen master 20 which has a size of 800 mm×1000 mm is divided into 20 sub-areas in 5 rows and 4 columns. In the examples presented, sub-areas positioned in four corners of each screen master of each size are set as the sub-areas Ea where tension should be obtained.

The numbers of sub-areas Ea into which the screen area E to perforate is divided and the positions of the sub-areas Ea where tension should be obtained, presented in FIG. 3, are not limited to those presented here.

The storage unit 13 is configured using any of diversified storage devices which are various semiconductor memories including a non-volatile memory such as, e.g., EEPROM or a flash memory and a volatile memory such as DRAM or SDRAM, HDD, etc. The storage unit 13 stores, inter alia, information on sizes of each stretched screen master 20, screen master information (the material and mesh count of a mesh fabric) which represents a type of a screen master 21 stretched as a stretched screen master 20, information representing the positions of sub-areas Ea where tension should be obtained, predetermined for each size of each stretched screen master 20, information for tension computation which is used to compute tension in sub-areas Eb where tension should not be obtained from a measured tension value obtained by the tension obtaining unit 12, and information for determining perforation conditions which is used to set perforation conditions. In addition, the storage unit 13 stores a drive control program required to drive each of the components of the printing screen making apparatus 1.

The above information for tension computation is information for modifying a measured tension value obtained in the sub-areas Ea where tension should be obtained of the screen area E to perforate according to the specifications of a stretched screen master 20.

In FIGS. 3A to 3C, modifying values (which differ by frame size) are specified which are assigned to each of the sub-areas where tension should not be obtained of the screen area E to perforate, in which these sub-areas are set depending on the size of a stretched screen master. That is, an average measured tension value, i.e., an average of tension values obtained by the tension obtaining unit 12 is modified by the modifying values assigned to the respective sub-areas Eb where tension should not be obtained, which are set for each frame size. As a result, provisional tension values for each of the sub-areas Eb where tension should not be obtained are calculated.

Variation in tension across a stretched screen master 20 may occur depending on a mesh fabric material and a mesh count. Therefore, the information for tension computation also includes coefficients which differ by mesh fabric material (material dependent coefficients) and coefficients which differ by mesh count (mesh count dependent coefficients) as coefficients for further modifying provisional tension values calculated by modifying an average measured tension value with the modifying values which differ by frame size. In the present embodiment, as the material dependent coefficients, an example is presented in which a coefficient of "1" is assigned to synthetic resin used as mesh fabric material and a coefficient of "0.5" is assigned to stainless steel used as mesh fabric material. For the mesh count dependent coefficients, an example is presented in which a coefficient of "1" is assigned to a mesh count of #120, a coefficient of "0.9" to a mesh count of #200, and a coefficient of "0.8" to a mesh count of #300.

That is, a tension computing unit 14*a* which will be described later calculates provisional tension values by modifying an average measured tension value with the modifying values which differ by frame size, selected according to the frame size of a stretched screen master 20. After that, the tension computing unit 14*a* further multiplies the provisional tension values by material dependent coefficients and mesh count dependent coefficients appropriate for the master information of the stretched screen master 20 in turn. Thereby, computed tension values suitable for each of the sub-areas Eb where tension should not be obtained are calculated.

The information for determining perforation conditions is information for determining suitable perforation conditions according to a measured tension value obtained by the tension obtaining unit 12 and computed tension values computed by the tension computing unit 14*a*.

Figure 4A:
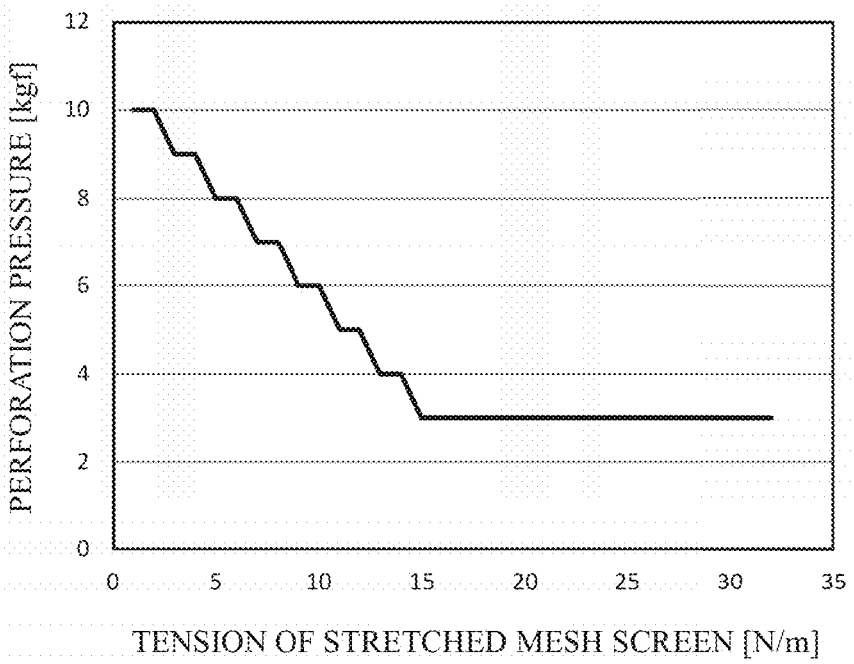
FIG. 4A is a graph representing a relation of perforation pressure versus screen master tension as information for determining perforation conditions.

FIG. 4A represents a relation between tension [N/m] of a stretched screen master 20 and perforation pressure [kgf], which is information for appropriately adjusting the perforation conditions so that perforation pressure is set in relation to a measured tension value and computed tension values. It is indicated in FIG. 4A that a reference tension value is set at 15 N/m and, when tension is lower than this border value, perforation pressure (3 kgf) mapped to the reference tension is modified.

Figure 4B:
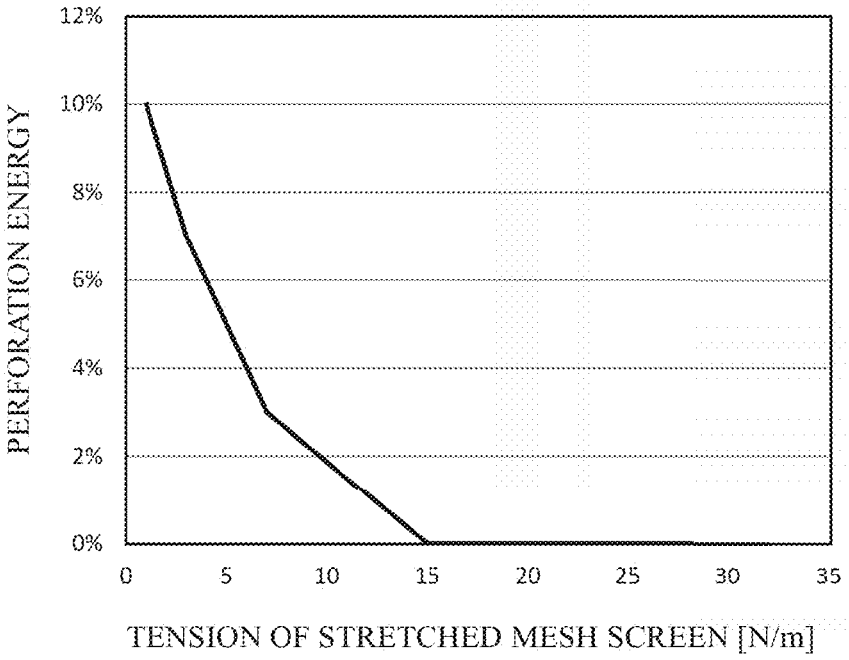
FIG. 4B is a graph representing a relation of perforation energy versus screen master tension as information for determining perforation conditions.

FIG. 4B represents a relation between tension [N/m] of a stretched screen master 20 and perforation energy, which is information for appropriately adjusting the perforation conditions so that perforation energy is set in relation to a measured tension value and computed tension values. It is indicated in FIG. 4B that a reference tension value is set at 15 N/m and, when tension is lower than this border value, perforation energy mapped to the reference tension is modified.

The control unit 14 is configured with, e.g., a CPU (Central Processing Unit), ROM (Read Only Memory), and RAM (Random Access Memory) or processors such as MPUs (Micro-Processing Units) having these functions and performs driving and control of the components of the printing screen making apparatus 1 according to a drive control program stored in the storage unit 13.

The control unit 14 includes a tension computing unit 14*a* which computes tension in sub-areas Eb where tension should not be obtained of the screen area E to perforate from a measured tension value obtained by the tension obtaining unit 12 and a perforation conditions determination processing unit 14*b* which controls the screen making unit 11 by perforation conditions determined according to tension values in the screen area E to perforate (a measured tension value obtained by the tension obtaining unit 12 and computed tension values computed by the tension computing unit 14*a*).

The tension computing unit 14*a* executes tension computation processing to compute tension in sub-areas Eb where tension should not be obtained of the screen area E to perforate, using a measured tension value obtained by the tension obtaining unit 12 and information for tension computation stored in the storage unit 13 and outputs computed tension values of tension computed for each of the sub-areas Eb where tension should not be obtained to the perforation conditions determination processing unit 14*b*.

The tension computation processing is as follows. First, the tension computing unit averages measured tension values obtained by the tension obtaining unit 12 in sub-areas Ea where tension should be obtained. Then, the tension computing unit selects modifying values which differ by frame size, those appropriate for a stretched screen master 20 to be perforated to make a printing screen from the information for tension computation stored in the storage unit 13 and modifies an average measured tension value with the modifying values assigned to sub-areas Eb where tension should not be obtained of the screen master, thus calculating provisional tension values for each of the sub-areas Eb where tension should not be obtained. Then, the tension computing unit multiplies the thus computed tension values by a material depending coefficient assigned to the mesh fabric material of the stretched screen master 20 and by a mesh count dependent coefficient assigned to the mesh count of the mesh fabric in turn. Thereby, computed tension values suitable for each of the sub-areas Eb where tension should not be obtained are obtained. The tension computation processing is not limited to the above-described computation method. Tension in sub-areas Eb where tension should not be obtained can be computed from a measured tension value obtained by tension obtaining unit 12 through the use of a predefined computation processing program.

Based on information for determining perforation conditions stored in the storage unit 13, the perforation conditions determination processing unit 14*b* determines perforation conditions suitable for each of the sub-areas of the screen area E to perforate from a measured tension value obtained by the tension obtaining unit 12 and computed tension values computed by the tension computing unit 14*a* and controls driving of the screen making unit 11.

A process for determining perforation conditions is as follows. A measured tension value obtained by the tension obtaining unit 12 and computed tension values computed by the tension computing unit 14*a* are compared with information for determining perforation conditions and perforation conditions are determined in relation to the measured tension value or computed tension values. Specifically, when perforation pressure is modified, perforation condition (perforation pressure) values of sub-areas are determined by adjusting a reference value of perforation pressure so that perforation pressure is set in relation to the tension values of the sub-areas, using information presented in FIG. 4A. When perforation energy is modified, perforation condition (perforation energy) values of sub-areas are determined by adjusting a reference value of perforation energy so that perforation energy is set in relation to the tension values of the sub-areas, using information presented in FIG. 4B.

In the present embodiment, when determining perforation conditions, values of both perforation pressure and perforation energy are determined in relation to a measured tension value and computed tension values. However, only by determining condition values of at least one of perforation energy and perforation pressure, a process of making a good printing screen can be implemented.

{Processing Operations}

In the printing screen making apparatus 1 of the first embodiment described hereinbefore, a series of processing operations for making a printing screen is described with reference to FIGS. 3 and 5.

In an example of processing operations described below, a stretched screen master 20 to be perforated to make a printing screen is assumed as follows: its frame size is "600 mm×800 mm" for which the modifying values are as presented in FIG. 3A; mesh fabric material is "synthetic resin"; and mesh count is "#120". An average measured tension value in sub-areas Ea where tension should be obtained is assumed to be "16 N/m".

Before executing the process of making a printing screen, first, the screen making unit 11 is made to serve as the tension obtaining unit 12. It measures tension in sub-areas Ea where tension should be obtained, which are set in the screen area E to perforate, and obtains a measured tension value in the sub-areas.

Then, the tension computing unit 14*a* executes tension computation processing, using the measured tension value and information for tension computation stored in the storage unit 13, and calculates computed tension values in each of sub-areas Eb where tension should not be obtained of the screen area E to perforate.

As presented in FIG. 5A, the tension computation process first modifies an average measured tension value of "16 N/m" in the sub-areas Ea where tension should be obtained with the modifying values for the frame size of 600 mm×800 mm and thus calculates provisional tension values for each of the sub-areas Eb where tension should not be obtained. Then, the process multiplies the calculated provisional tension values in each of the sub-areas Eb where tension should not be obtained by a material depending coefficient of "1", as presented in FIG. 5B, and multiplies the provisional tension values by a mesh count dependent coefficient of "1", as presented in FIG. 5C. Thereby, computed tension values for each of the sub-areas Eb where tension should not be obtained are calculated, as presented in FIG. 5D.

Then, the measured tension value obtained by the tension obtaining unit 12 and the computed tension values computed by the tension computing unit 14*a* are compared against information for determining perforation conditions stored in the storage unit 13 to determine perforation condition values fit for the sub-areas Ea where tension should be obtained and the sub-areas Eb where tension should not be obtained. That is, because a measured tension value in the sub-areas Ea where tension should be obtained is 16 N/m and a computed tension value in the sub-areas Eb where tension should not be obtained is 14 N/m or 11 N/m as presented in FIG. 5D, perforation conditions (perforation pressure and perforation energy) appropriate for these tension values are determined based on the information for determining perforation conditions.

When the process of making a printing screen is executed, the screen making unit 11 is controlled according to the determined perforation conditions and executes the screen making process.

[Second Embodiment]

Next, a structure of a printing screen making apparatus 1 of a second embodiment is described.

In the printing screen making apparatus 1 of the second embodiment which will be described below, components corresponding to those of the printing screen making apparatus 1 of the first embodiment described previously are assigned the same reference numerals, and description about the components and processing that they involve is not repeated. Components that differ from those in the first embodiment, functions that have been added newly, and processing they involve are described.

<Apparatus Structure>

Figure 6A:
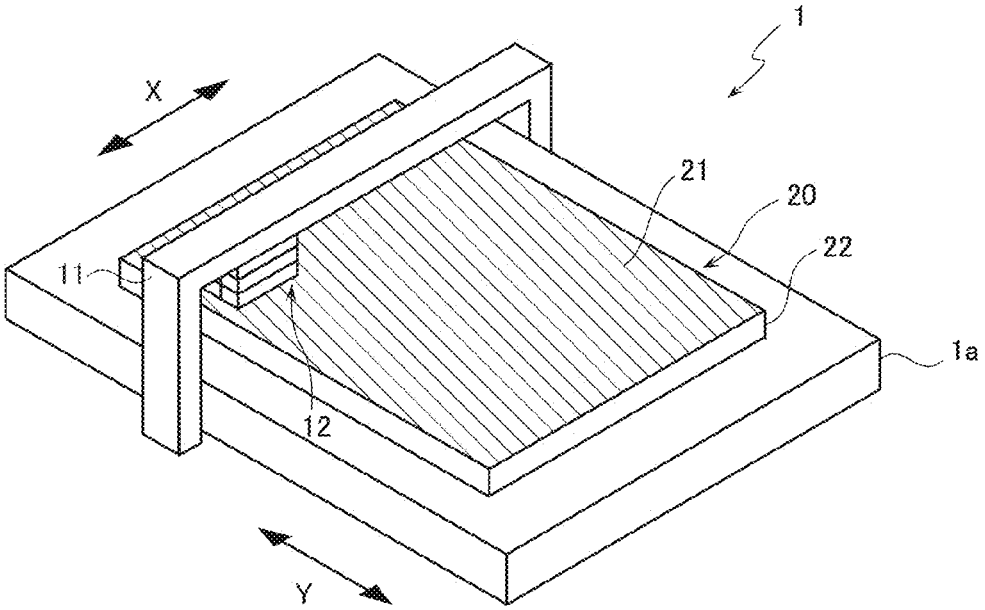
FIG. 6A is a schematic perspective view depicting a structure of a printing screen making apparatus of a second embodiment pertaining to the present invention.
Figure 6B:
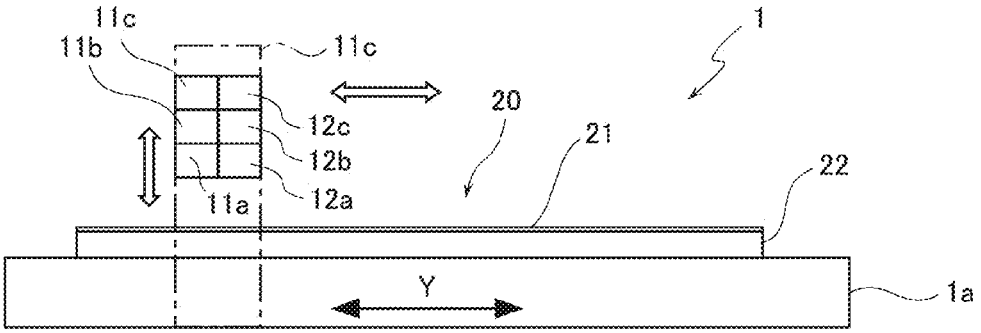
FIG. 6B is a side view of the same apparatus.
Figure 7:
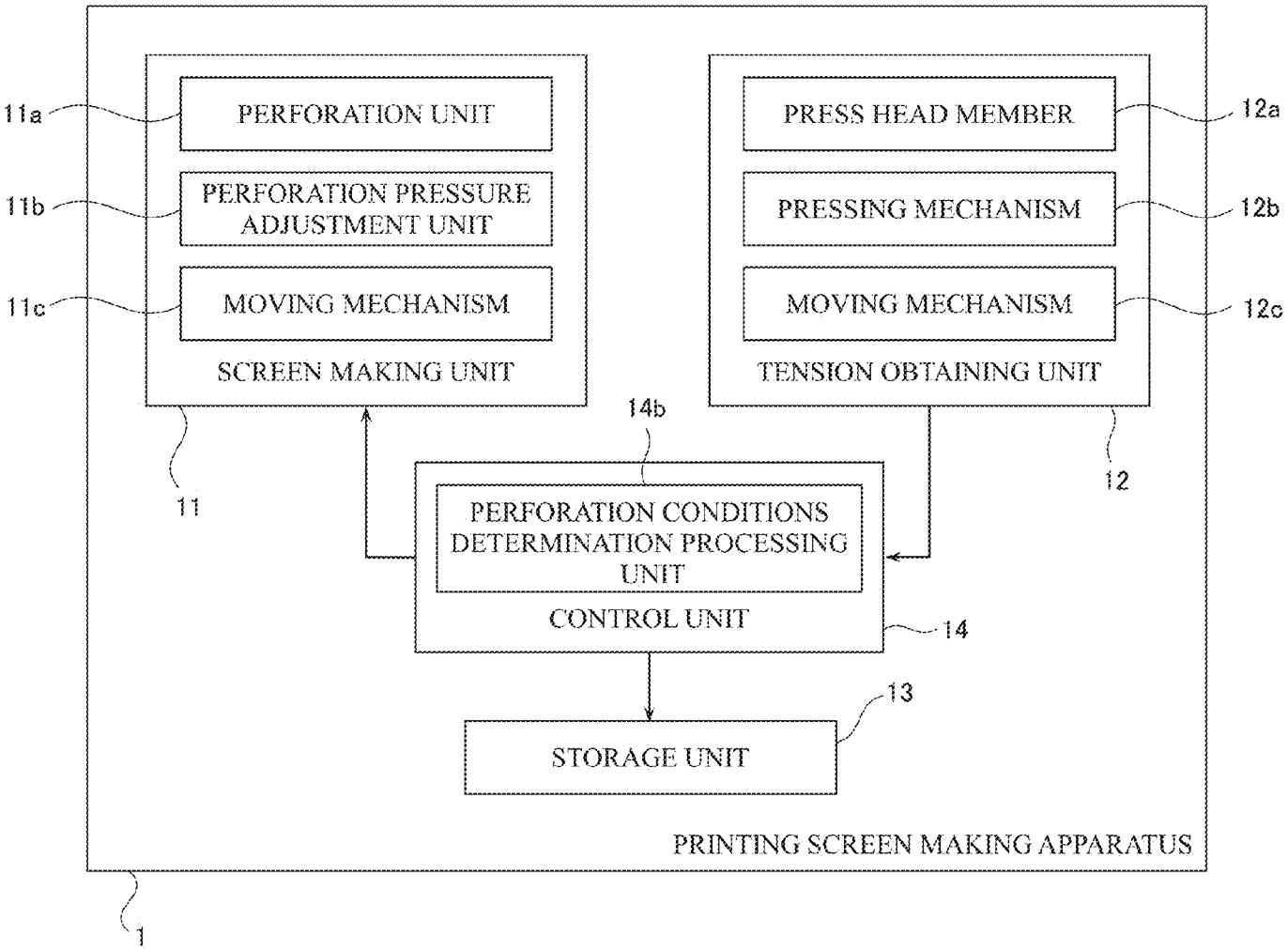
FIG. 7 is a functional block diagram of the printing screen making apparatus of the second embodiment.
Figure 8A:
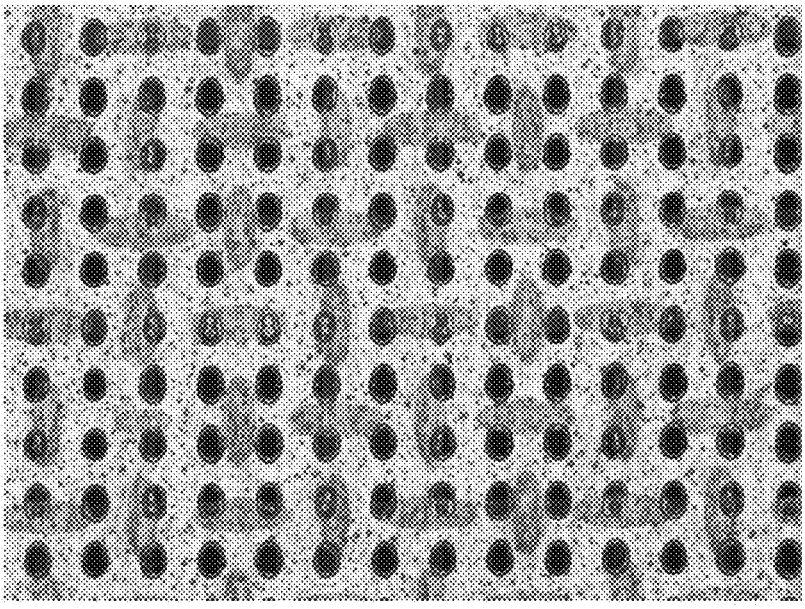
FIG. 8A is a photograph of an enlarged part of a properly perforated screen master.
Figure 8B:
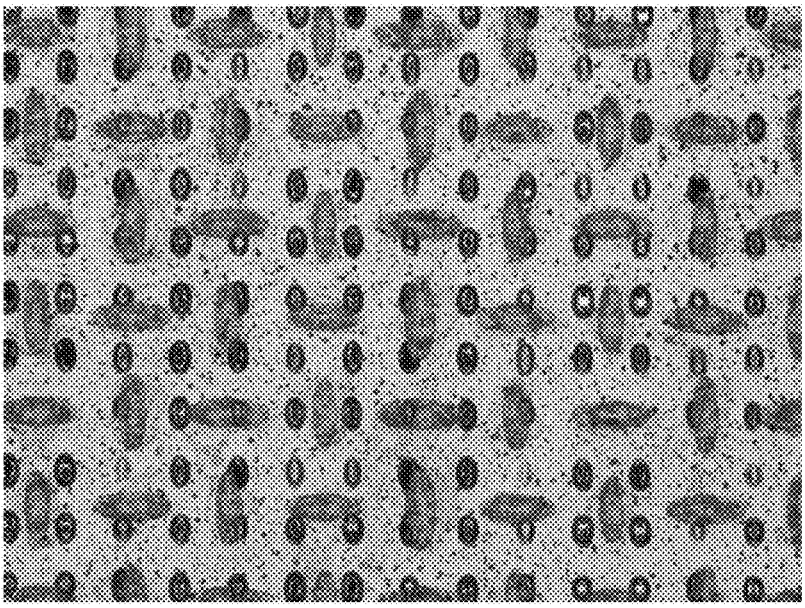
FIG. 8B is a photograph of an enlarged part of a poorly perforated screen master.
Figure 9C:
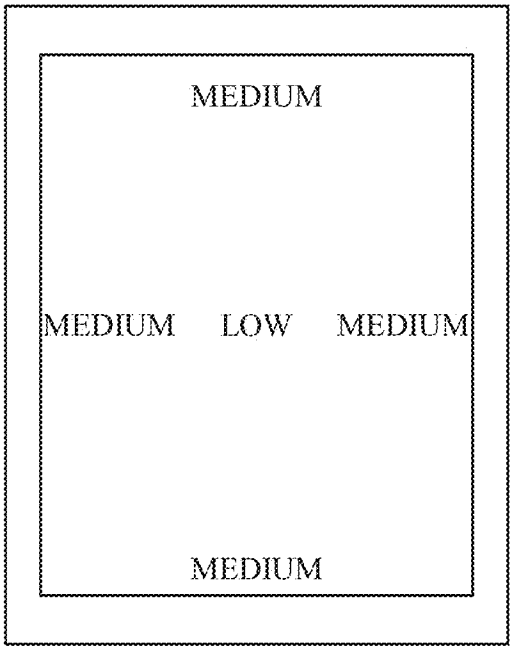
FIGS. 9A to 9C are diagrams which qualitatively represents distribution of tension across a screen master depending on frame size for screen masters of the same type stretched on a frame in a tense state with uniform tensile force.
Figure 9B:
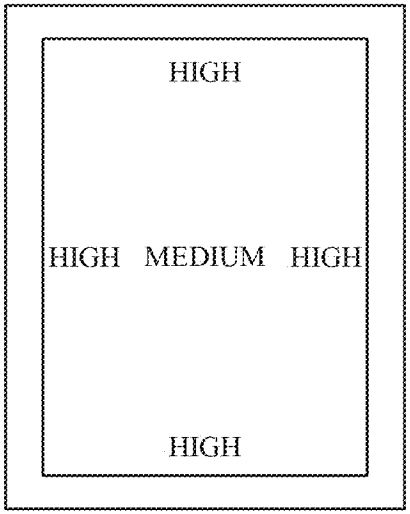
Figure 9A:
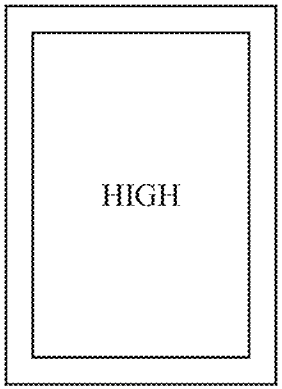

The printing screen making apparatus 1 of the second embodiment, as is depicted in FIG. 6 or FIG. 7, is comprised of a screen making unit 11, a tension obtaining unit 12, a storage unit 13, and a control unit 14; its basic structure is the same as the apparatus of the first embodiment.

The printing screen making apparatus 1 of the first embodiment obtains tension in sub-areas Ea where tension should be obtained, which are set in the screen area E to perforate, computes tension in sub-areas Eb where tension should not be obtained of the screen area E to perforate, and thereby determines perforation conditions for the screen making unit 11. On the other hand, the printing screen making apparatus 1 of the second embodiment does not compute tension in sub-areas Eb where tension should not be obtained and sets a perforation target portion of the screen area E to perforate as a sub-area Ea where tension should be obtained. According to tension measured from this sub-area Ea where tension should be obtained, the apparatus determines suitable perforation conditions for each sub-area and controls driving of the screen making unit 11.

The tension obtaining unit 12 is disposed to abut the front of the screen making unit 11 in the slow-scan direction Y and includes a press head member 12*a* which is pressed against a screen master 21 and a pressing mechanism 12*b* which presses the press head member 12*a* with predetermined pressing force. The tension obtaining unit 12 also includes a moving mechanism 12*c* which moves the unit in the first-scan direction X in the same way as the screen making unit 11 and is moved in the slow-scan direction Y by sharing the moving mechanism 11*c* of the screen making unit 11.

In the printing screen making apparatus 1 of the second embodiment, the tension obtaining unit 12 obtains tension each time it moves along a lane of screen making in order in the slow-scan direction Y from the screen making process start position in the screen area E to perforate. The apparatus executes the process of making a printing screen, while controlling the screen making unit 11 by perforation conditions that have been determined according to tension obtained in a sub-area just before the sub-area is perforated.

In this way, in the printing screen making apparatus 1 of the second embodiment, it is not required to drive the screen making unit 11 separately for a screen making process and a tension obtaining process, as in the first embodiment. The apparatus of the second embodiment enables parallel execution of "a process of obtaining tension from a sub-area Ea where tension should be obtained just before the sub-area is perforated" and "a process of making a screen (peroration) by perforation conditions determined based on a measured tension value obtained just before doing it" and, therefore, it has an advantage in which processing time taken to complete the process of making a printing screen can be shortened.

Routes in which the screen making unit 11 and the tension obtaining unit 12 will move correspond to routes in which the screen making unit will move during the process of making a printing screen, as in the case for the first embodiment. As for sub-areas Ea where tension should be obtained in the present embodiment, one of a predetermined number of sub-areas into which the screen area E to perforate is divided, which corresponds to a target portion where perforation is now going to be executed, is sequentially set as a sub-area Ea where tension should be obtained for the purpose of shortening the processing time. However, all sub-areas into which the screen area E to perforate is divided may be set as sub-areas Ea where tension should be obtained.

Moreover, because it is not needed in the second embodiment to compute tension in sub-areas Eb where tension should not be obtained, the storage unit 13 in the second embodiment is not to store information on sizes of each stretched screen master 20, screen master information of a stretched screen master 20 to be perforated to make a printing screen, and information for tension computation. The storage unit 13 is to store a drive control program for driving the apparatus components and, in addition, information representing the positions of sub-areas Ea where tension should be obtained, predetermined for each size of each stretched screen master 20, and information for determining perforation conditions which is used to set perforation conditions.

The control unit 14 dispenses with a tension computing unit 14*a* which computes tension based on a measured tension value obtained in sub-areas Ea where tension should be obtained and is configured including a perforation conditions determination processing unit 14*b* which determines perforation conditions.

The perforation conditions determination processing unit 14*b* of the second embodiment determines suitable perforation conditions for each of the sub-areas Ea where tension should be obtained, based on a measured tension value obtained by the tension obtaining unit 12 in the sub-areas Ea where tension should be obtained and information for determining perforation conditions stored in the storage unit 13, as in the case for the process of determining perforation conditions performed in the first embodiment.

<Processing Operations>

In the printing screen making apparatus 1 of the second embodiment, then, a series of processing operations for making a printing screen is described. Here is an example of operation when the screen area E to perforate is divided into multiple sub-areas and one of the sub-areas which corresponds to a perforation target portion is set as a sub-area Ea where tension should be obtained.

When the screen making unit 11 and the tension obtaining unit 12 have come at the sub-area Ea where tension should be obtained of the screen area E to perforate, before the execution of a screen making process, the tension obtaining unit 12 is driven. The tension obtaining unit 12 measures tension in the sub-area Ea where tension should be obtained and outputs the measured tension as a measured tension value to the control unit 14.

Then, the measured tension value obtained by the tension obtaining unit 12 is compared against information for determining perforation conditions stored in the storage unit 13 to determine perforation conditions fit for the sub-area Ea where tension should be obtained. According to the thus determined perforation conditions, the screen making unit 11 is controlled to execute a screen making process.

When the screen making process terminates, the screen making unit 11 and the tension obtaining unit 12 are moved to a next sub-area Ea where tension should be obtained in a lane of screen making. When these units have come at the sub-area Ea where tension should be obtained, the perforation conditions determination processing unit 14*b* determines perforation conditions based on a measured tension value obtained by the tension obtaining unit 12 before a screen making process. According to the thus determined perforation conditions, the screen making unit 11 is controlled to execute a screen making process.

As described hereinbefore, the printing screen making apparatus 1 of the first embodiment described previously makes the screen making unit 11 serve as the tension obtaining unit 12 to measure tension in sub-areas Ea where tension should be obtained, which are set in the screen area E to perforate of a stretched screen master 20, and obtain a measured tension value. Then, tension in sub-areas Eb where tension should not be obtained of the screen area E to perforate, other than the sub-areas Ea where tension should be obtained, is calculated as computed tension values by appropriately modifying the measured tension value obtained by the tension obtaining unit 12, based on predefined information for tension computation. And, the apparatus compares the measured tension value and the computed tension values against information for determining perforation conditions stored in the storage unit 13, determines perforation conditions suitable for tension in the sub-areas Ea where tension should be obtained and for tension in the sub-areas Eb where tension should not be obtained, and, according to the thus determined perforation conditions for each sub-area, controls the screen making unit 11 to execute a screen making process.

Accordingly, the apparatus can perform a process of making a printing screen on peroration conditions suitable for each of screen master portions in which variation in tension occurred depending on the size of a frame 22 and the specifications of a stretched screen master 20. Thus, it is not needed to prepare platens for each stretched screen master 20, as in the related art apparatus, and a process of making a good printing screen can be executed only with the perforation unit 11*a*. Since it is possible to perform a screen making process while eliminating poor perforation attributed to variation in tension, this eventually leads to improvement in image quality of half-tone and edges.

Moreover, the apparatus computes tension in sub-areas Eb where tension should not be obtained of the screen area E to perforate, based on measured tension value obtained by measuring tension in sub-areas Ea where tension should be obtained, which are set in the screen area E to perforate, and using predefined information for tension computation. It is thus possible to capture variation in tension occurred across the screen area E to perforate with ease without obtaining tension in all sub-areas of the screen area E to perforate.

In the printing screen making apparatus 1 of the second embodiment, the screen making unit 11 and the tension obtaining unit 12 are separate components to enable parallel execution of a screen making process and a tension obtaining process. During a screen making process, while moving along routes to move, the tension obtaining unit 12 obtains a measured tension value by measuring tension in a sub-area Ea where tension should be obtained, which corresponds to a perforation target portion of the screen area E to perforate, just before the sub-area is perforated. And, the apparatus compares the measured tension value just before the sub-area is perforated against information for determining perforation conditions stored in the storage unit 13, determines perforation conditions suitable for the tension in the sub-area Ea where tension should be obtained, and, according to the determined perforation conditions, controls the screen making unit 11 to execute a screen making process.

Accordingly, as in the case for the first embodiment, the apparatus can perform a process of making a printing screen on peroration conditions suitable for screen master portions in which variation in tension occurred across the screen area E to perforate depending on the specifications of a stretched screen master 20. Thus, a stable process of making a printing screen can be performed without preparing platens for each stretched screen master 20. Because a screen making process and a tension obtaining process can be executed in parallel, processing time can be shortened, as it does not take time for an additional tension obtaining process.

[Other Embodiments]

The present invention is not limited to the embodiments described in the foregoing context and may be carried out, appropriately modified depending on usage environments and the like, for example, as will be described below. Modification examples described below may be carried out in any combination with another embodiment without departing from the scope of the invention.

In the foregoing apparatus of the first embodiment, the screen making unit 11 also serves as the tension obtaining unit 12, as described previously. This is non-limiting and the screen making unit 11 and the tension obtaining unit 12 may be provided as separate components, for example, as in the apparatus structure of the second embodiment. While the screen making unit 11 and the tension obtaining unit 12 are provided as separate components in the apparatus of the second embodiment, as described by way of example, the screen making unit 11 may also serve as the tension obtaining unit 12 as in the first embodiment. In this case, a tension obtaining process must be executed through the use of the screen making unit 11 prior to a screen making process, as in the case for the first embodiment.

As described for each of the embodiments, the tension obtaining unit 12 is configured to obtain tension in sub-areas Ea where tension should be obtained by pressing against the surface of a stretched screen master 20; however, this is non-limiting. For example, using a tension measuring device which is a separate one from the printing screen making apparatus 1, tension in sub-areas Ea where tension should be obtained of a stretched screen master 20 may be obtained in advance. The thus obtained tension (a measured tension value) in each of the sub-areas Ea where tension should be obtained may be input to the control unit 14 via an external terminal device such as a PC (personal computer) or an operator input unit (which is not depicted) comprised of, e.g., a liquid crystal panel and a keyboard. In this case, the external terminal device or the operator panel serves as the tension obtaining unit 12.

REFERENCE SIGNS LIST

1 . . . printing screen making apparatus
11 . . . screen making unit (11*a* . . . perforation unit, 11*b* . . . perforation pressure adjustment unit, 11*c* . . . moving mechanism)
12 . . . tension obtaining unit
13 . . . storage unit
14 . . . control unit (14*a* . . . tension computing unit, 14*b* . . . perforation conditions determination processing unit)
20 . . . stretched screen master
21 . . . screen master
22 . . . frame
E . . . screen area (Ea . . . sub-area where tension should be obtained, Eb . . . sub-area where tension should not be obtained)

The invention claimed is:

1. A printing screen making apparatus comprising:

a perforation unit that moves relatively to a stretched screen master prepared by stretching a screen master made of a mesh fabric and a thermally fusible film on a frame in a tense state with predetermined tensile force and thermally fuses and perforates segments of the film corresponding to image components in original data;

a tension obtaining unit that obtains tension in a predetermined screen area to perforate of the stretched screen master; and a control unit that controls the perforation unit to execute perforation on perforation conditions set according to tension obtained by the tension obtaining unit.

2. The printing screen making apparatus according to claim 1, wherein the tension obtaining unit obtains tension from sub-areas where tension should be obtained, which are set in the screen area to perforate of the stretched screen master, and wherein the control unit computes tension in sub-areas where tension should not be obtained of the screen area to perforate, other than the sub-areas where tension should be obtained, from the tension obtained by the tension obtaining unit, determines perforation conditions in the sub-areas where tension should not be obtained from the thus computed tension, and determines perforation conditions in the sub-areas where tension should be obtained from the tension obtained by the tension obtaining unit.

3. The printing screen making apparatus according to claim 2, wherein the control unit comprises:

a tension computing unit that calculates provisional tension values by modifying a measured tension value, the tension measured by the tension obtaining unit from the sub-areas where tension should be obtained, with modifying values which differ by frame size, set for each size of the stretched frame master, and calculates computed tension values as tension in the sub-areas where tension should not be obtained by multiplying the provisional calculated tension values by a material dependent coefficient for material of the mesh fabric in the screen master and a mesh count dependent coefficient for a mesh count of the mesh fabric; and a perforation conditions determination processing unit that compares the measured tension value and the computed tension values against information for determining perforation conditions, which represents a relation between tension and perforation conditions, determines perforation conditions fit for the measured tension value and the computed tension values, and controls the perforation unit to execute perforation on the determined perforation conditions.

4. The printing screen making apparatus according to claim 1, wherein the tension obtaining unit, when obtaining tension, calculates tension of the screen master from pressing force exerted when the perforation unit has been pressed against the screen master film surface in the screen area to perforate of the stretched screen master, and wherein the control unit, when making a printing screen, controls the perforation unit to execute perforation on perforation conditions fit for tension of the screen master obtained by the tension obtaining unit.

* * * * *